US012023779B2

(12) United States Patent
Lam

(10) Patent No.: US 12,023,779 B2
(45) Date of Patent: Jul. 2, 2024

(54) POST-CHEMICAL MECHANICAL POLISHING BRUSH CLEANING BOX

(71) Applicant: Applied Materials, Inc., Santa Clara, CA (US)

(72) Inventor: Gary Ka Ho Lam, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 294 days.

(21) Appl. No.: 17/375,961

(22) Filed: Jul. 14, 2021

(65) Prior Publication Data

US 2023/0013401 A1 Jan. 19, 2023

(51) Int. Cl.

| | |
|---|---|
| ***B24B 37/34*** | (2012.01) |
| ***A46B 13/00*** | (2006.01) |
| ***A46B 13/02*** | (2006.01) |

(52) U.S. Cl.

CPC ..... *B24B 37/34* (2013.01); *A46B 13/001* (2013.01); *A46B 13/02* (2013.01); *A46B 2200/3073* (2013.01)

(58) Field of Classification Search

CPC ..... H01L 21/67046; H01L 21/02074; B08B 3/02; B08B 1/04; A46B 2200/3073; A46B 13/02; A46B 13/001; B24B 37/34

USPC ..... 15/159.1

See application file for complete search history.

(56) References Cited

U.S. PATENT DOCUMENTS

| | | | | |
|---|---|---|---|---|
| 5,901,399 | A * | 5/1999 | Moinpour | H01L 21/67046 15/21.1 |
| 6,457,199 | B1 | 10/2002 | Frost et al. | |
| 8,388,762 | B2 | 3/2013 | Freer et al. | |
| 8,778,087 | B2 | 7/2014 | Tyrrell et al. | |
| 9,704,729 | B2 | 7/2017 | Cho et al. | |
| 10,269,555 | B2 * | 4/2019 | Huang | B08B 1/002 |
| 2007/0181153 | A1 * | 8/2007 | Kobayashi | B08B 1/04 134/2 |
| 2014/0209239 | A1 * | 7/2014 | Ko | H01L 21/02096 15/97.1 |

FOREIGN PATENT DOCUMENTS

| | | | |
|---|---|---|---|
| CN | 107871697 | B | 4/2020 |
| CN | 212120884 | U | 12/2020 |
| CN | 112589668 | A | 4/2021 |
| JP | 2001054765 | A | 2/2001 |
| JP | 6977175 | B2 | 8/2016 |

OTHER PUBLICATIONS

International Search Report issued to PCT/US2022/031749 on Sep. 15, 2022.

* cited by examiner

*Primary Examiner* — Katina N. Henson

(74) *Attorney, Agent, or Firm* — Patterson + Sheridan, LLP

(57) ABSTRACT

Embodiments provided herein include a system and method for cleaning a first surface of a substrate using a brush carousel assembly. In one embodiment, the brush carousel assembly includes one or more rotatable brush mounting assemblies coupled to a rotatable carriage, having a carriage support structure configured to rotate about a carriage axis. The brush carousel assembly further includes a second brush mounting assembly disposed a second radial distance from the carriage axis, and coupled to the support structure of the carriage that includes the one or more rotatable support members.

15 Claims, 4 Drawing Sheets

POST-CHEMICAL MECHANICAL POLISHING BRUSH CLEANING BOX

BACKGROUND

Field

The present disclosure relates generally to an apparatus and method for processing a substrate. More particularly, the present invention relates to an apparatus and method for cleaning a first surface of a substrate using a brush carousel assembly.

Description of the Related Art

During chemical mechanical polishing (CMP) processing, scattered particles, such as Cu, Ta, W, TaN, or Ti, may accumulate on both the front surface and back surface of a substrate. To properly remove the scattered particles, most post-CMP cleaning processes consist of a series of steps that typically include physical cleaning. Typically, the physical cleaning methods largely consist of physically removing excess metals with scrubbing brushes.

Post-CMP scrubbing brushes (i.e., scrubbers) remove particles by directly contacting the brush with the substrate surface. Typical scrubber assemblies consist of one brush on either side of the substrate surface. Since both brushes are in constant contact with the substrate, traditional scrubbers typically lack the ability to clean and/or condition brushes mid-cycle. Thus, inefficient cleaning and cross-contamination from substrate to substrate is common, as the brushes may not be completely clean from the previous cleaning cycle of the previous substrate.

Therefore, what is needed in the art is a scrubbing brush assembly that can increase cleaning efficacy, while also decreasing cross-contamination from substrate to substrate by cleaning/conditioning the scrubber brushes throughout the processing cycle, without interrupting the cleaning process.

SUMMARY

The present disclosure generally relates to a polishing system comprising a cleaning chamber, a plurality of polishing stations, and a transfer assembly. The plurality of polishing stations include a polishing pad configured to polish a substrate. The transfer assembly is configured to transfer a substrate from one of the plurality of polishing stations to the cleaning chamber. The cleaning chamber further includes a brush carousel assembly that includes a carriage configured to rotate or pivot about a carriage axis, and a plurality of first brush mounting assemblies coupled to the carriage. Each of the plurality of first brush mounting assemblies comprises one or more rotatable support members configured to support a brush assembly and rotate about a corresponding brush axis, wherein each of the respective brush axes are spaced about the carriage axis, and a second brush mounting assembly disposed a distance from the brush carousel assembly. The second brush mounting assembly is disposed a distance from the brush carousel assembly such that one of the plurality of first brush mounting assembly and the second brush mounting assembly are configured to be positioned on opposing sides of a substrate when the substrate is positioned for processing within the cleaning chamber.

Embodiments of the present disclosure further include a brush carousel assembly that includes a carriage having a support structure that is configured to rotate about a carriage axis, a first brush mounting assembly coupled to the support structure of the carriage, and a second brush mounting assembly coupled to the support structure of the carriage. The first brush mounting assembly includes one or more rotatable first brush support members rotatable about a first brush axis, and coupled to the first brush. In this configuration, the first brush axis is disposed a first radial distance from the carriage axis. The second brush mounting assembly includes one or more rotatable second brush support members rotatable about a second brush axis and coupled to a second brush. In this configuration, the second brush axis is disposed a second radial distance from the carriage axis.

Embodiments of the present disclosure further include a method of processing a substrate that includes rotating a carriage of a brush carousel assembly, disposed on a first side of a processing volume, about a carriage axis to position a first brush in a processing position, and simultaneously positioning a second brush in a non-processing position. The method further includes rotating the first brush about a first brush axis, while the first brush is in the processing position, and concurrently rotating the second brush about a second brush axis while the second brush is in the non-processing position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
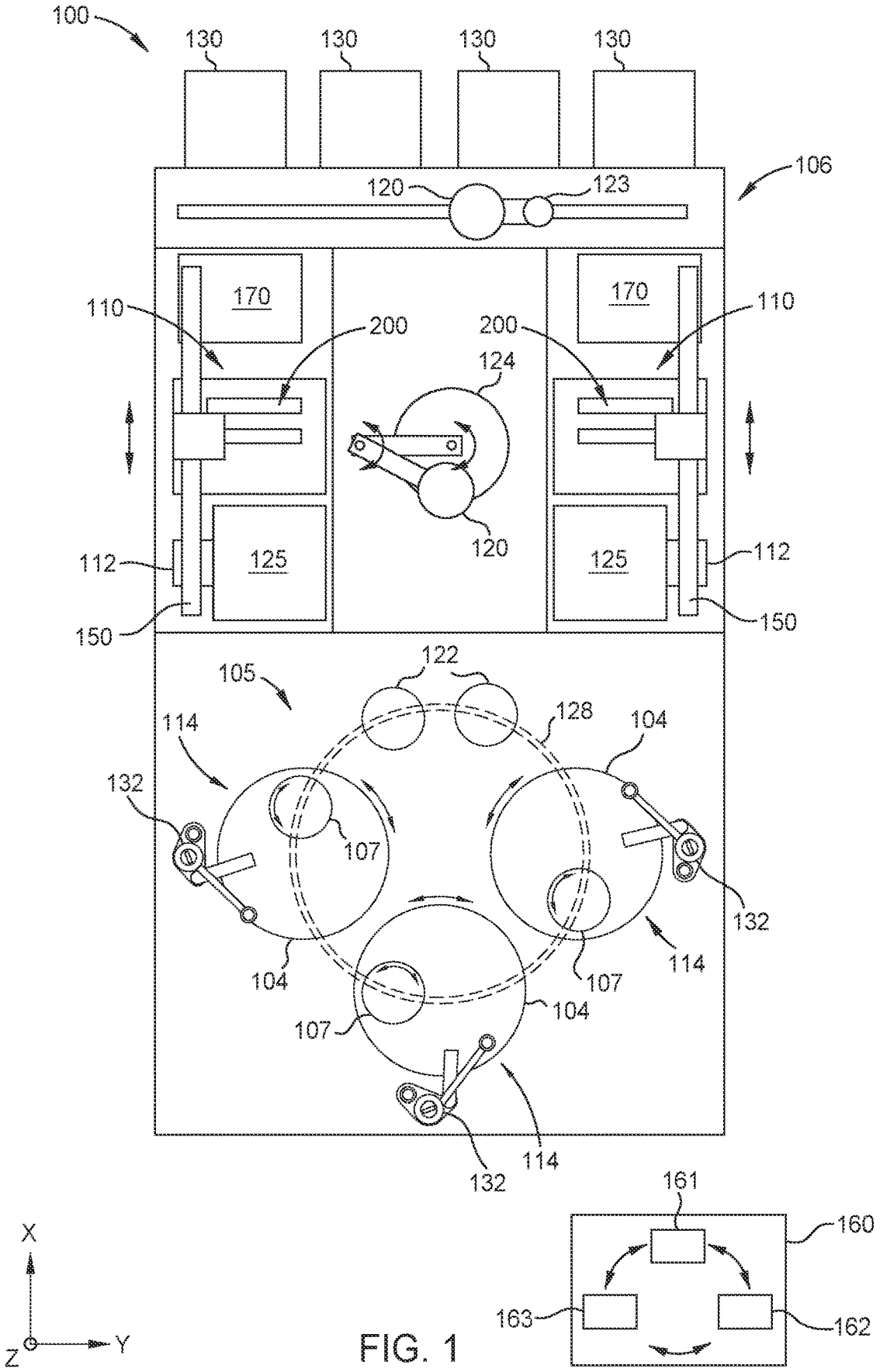
FIG. 1 is a schematic plan view of an exemplary chemical mechanical polishing (CMP) processing system.

FIG. 1 is a schematic plan view of an exemplary chemical mechanical polishing (CMP) processing system 100, which uses one or more brush box modules described herein. The exemplary CMP processing system 100 includes a substrate-polishing portion 105 and a second portion 106 coupled to the substrate-polishing portion 105 and integrated therewith. The substrate-polishing portion 105 features a plurality of polishing stations 114 on which substrates are polished, using a polishing pad 104, while being retained by a carrier head 107. The polishing stations 114 are sized to interface with one or more carrier heads 107 so that polishing of a substrate may occur in a single polishing station 114. The carrier heads 107 are coupled to a carriage (not shown) that is mounted to an overhead track 128 that is shown in phantom in FIG. 1. The overhead track 128 allows the carriage to be selectively positioned around the substrate-polishing portion 105 which facilitates positioning of the carrier heads 107 selectively over the polishing stations 114, and load cup 122. In the embodiment depicted in FIG. 1, the overhead track 128 has a circular configuration which allows the carriages retaining the carrier heads 107 to be selectively and independently rotated over and/or clear of the load cups 122 and the polishing stations 114. Each polishing station 114 comprises a pad conditioning assembly 132, which dresses the polishing surface of the polishing pad 104.

The second portion 106 includes one or more post-CMP cleaning stations 110, a plurality of substrate loading stations 130, and a plurality of substrate handlers, e.g., a factory interface robot 123 and one or more transfer robots 124. The one or more post-CMP cleaning stations 130 (two shown) include one or more horizontal pre-clean (HPC) modules 125, one or more drying units 170, and one or more vertical cleaning modules (i.e., brush box modules 200). The HPC module 125 is configured to process a substrate 120 disposed in a substantially horizontal orientation (i.e., x-y plane) and the vertical cleaning modules are configured to process substrates 120 disposed in substantially vertical orientations (i.e., z-y plane).

The factory interface robot 123 is positioned to transfer substrates 120 to and from the plurality of system loading stations 130, e.g., between the plurality of system loading stations 130 and a transfer robot 124. In some embodiments, the factory interface robot 123 is positioned to transfer the substrate 120 between any of the system loading stations 130 and a processing system positioned proximate thereto. For example in FIG. 1, the factory interface robot 123 is positioned to transfer the substrate 120 between the system loading stations 130 and the drying units 170. The transfer robot 124 is used to transfer the substrate 120 between the substrate-polishing portion 105 and the second portion 106. For example, here the transfer robot 124 is positioned to transfer a to-be-polished substrate 120 received from the factory interface robot 123 to the substrate-polishing portion 105 for polishing therein. The transfer robot 124 is then used to transfer the polished substrate 120 from the substrate-polishing portion 105, e.g., from a transfer station (not shown) within the substrate-polishing portion 105, to the HPC module 125 and/or one of the brush box modules 200.

The CMP processing system 100 is shown as having two cleaning stations 110 disposed on either side of the transfer robot 124. Here, each cleaning station 110 includes the horizontal pre-clean module 125, a spray box 112 (partially obscured by the horizontal pre-clean module 125, and a substrate handling system 150), the brush box module 200, the drying unit 170, and the substrate handling system 150 for transferring substrates 120 therebetween.

Typically, the horizontal pre-clean module 125 receives a polished substrate 120 from the transfer robot 124 where the substrate 120 is disposed in a horizontal orientation. The substrate handling system 150 is used to transfer the substrate 120 from the horizontal pre-clean module 125 into the brush box module 200. The substrate handling system 150 is also able to alter the orientation of the substrate 120 from a horizontal position (i.e., x-y plane) to a vertical positon (i.e., z-y plane). For example, the substrate handling system 150 may swing the substrate 120 from a horizontal position to a vertical position for vertical cleaning associated with the brush box module 200. The substrate handling system 150 further includes a plurality of substrate gripping mechanisms, and vertical rails for moving the gripping mechanisms. The gripping mechanisms are used to transfer substrates 120 to and from processing chambers, e.g., cleaning and drying modules disposed proximate to the handling system.

The drying unit 170 is used to dry the substrate 120 after the substrate has been processed by the brush box module 200 and before the substrate 120 is transferred to a system loading station 130. In one embodiment, the drying unit is a horizontal drying unit, and is configured to receive a substrate 120 disposed in a horizontal orientation. In this embodiment, the substrate handling system 150 would swing the substrate 120 back to a horizontal positon from a vertical position associated with the previous vertical cleaning step of the brush box module 200.

Figure 2:
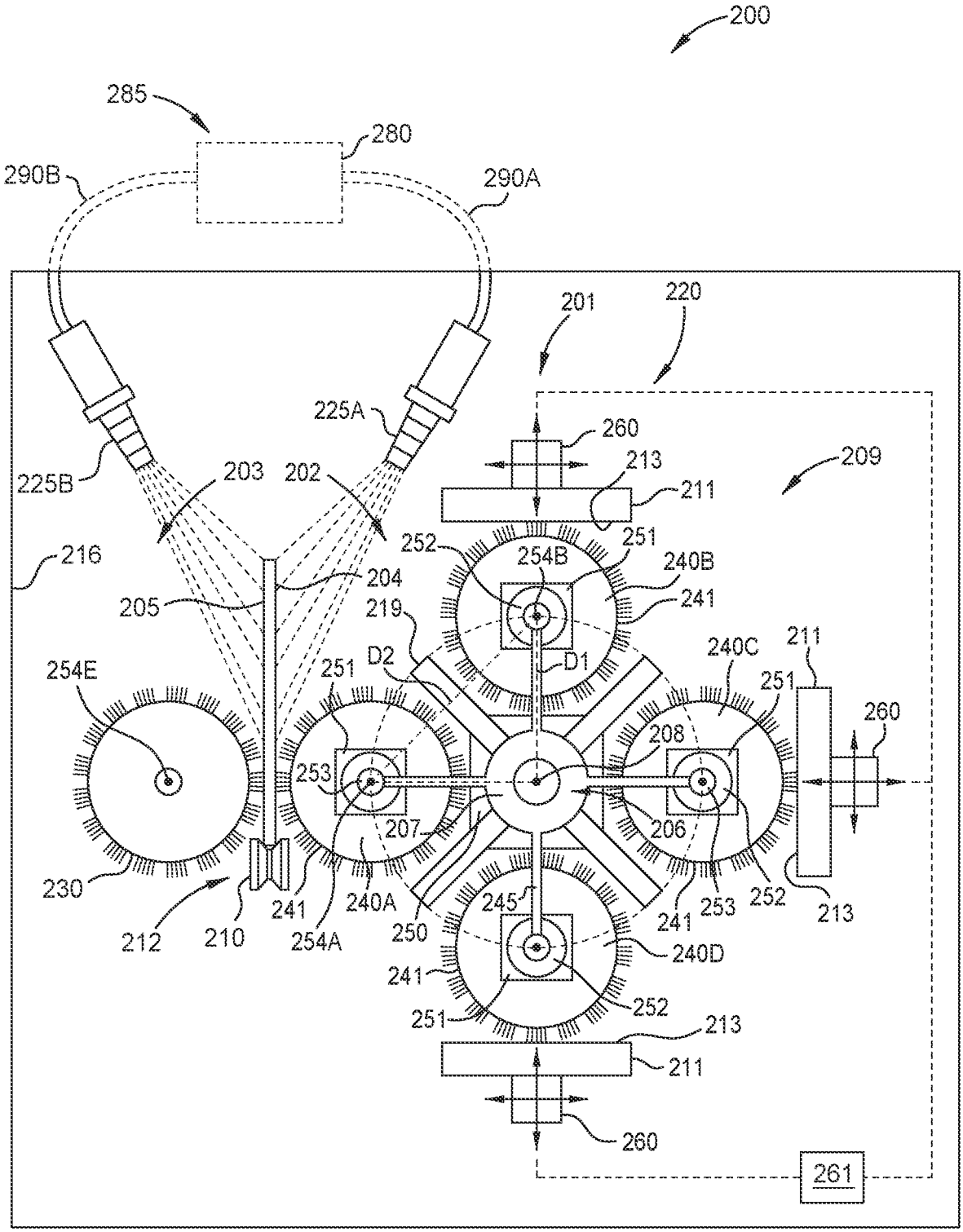
FIG. 2 is a schematic side sectional view of a brush box module that may be used with the CMP processing system of FIG. 1.

The CMP processing system 100 is operated by a system controller 160. In some embodiments, the system controller 160 can be configured to control any individual subsystem of the processing system 100. For example, the system controller 160 can be configured to individually control the brush box module 200 (FIG. 2), and/or the brush carousel assembly 220 (FIG. 2). Here, the system controller 160 includes a programmable central processing unit (CPU) 161 which is operable with a memory 162 (e.g., non-volatile memory) and support circuits 163. The support circuits 163 are conventionally coupled to the CPU 161 and comprise cache, clock circuits, input/output subsystems, power supplies and the like coupled to the various components of the CMP processing system 100 to facilitate control thereof. The CPU 161 is one of any form of general purpose computer processors used in an industry setting, such as a programmable logic controller (PLC), for controlling various components and sub-processors of the processing system. The memory 162, coupled to the CPU 161, is non-transitory and is typically one or more of readily available memories such as random access memory (RAM), read only memory (ROM), floppy disk drive, hard disk, or any other form of digital storage, local or remote.

Typically, the memory 162 is in the form of a non-transitory computer-readable storage media containing instructions (e.g., non-volatile memory), which when executed by the CPU 161, facilitates the operation of the CMP processing system 100. The instructions can conform to any one of a number of different programming languages, so long as they enable the functions of the embodiments and methods disclosed herein. For example, the disclosure may be implemented as a program (in any language) stored on computer-readable storage media for processing a substrate as disclosed herein.

Illustrative non-transitory computer-readable storage media include, but are not limited to: (1) non-writable storage media (e.g., read-only memory devices within a computer such as CD-ROM disk readable by a CD-ROM drive, flash memory, ROM chips or any type of solid-state non-volatile semiconductor memory devices, e.g., solid state drives (SSD) on which information may be permanently stored; and (2) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure. In some embodiments, the methods set forth herein, or portions thereof, are performed by one or more application specific integrated circuits (ASICs), field-programmable gate arrays (FPGAs), or other types of hardware implementations. In some other embodiments, the substrate processing and/or handling methods set forth herein are performed by a combination of software routines, ASIC(s), FPGAs and, or, other types of hardware implementations. One or more system controllers 160 may be used with one or any combination of the various modular polishing systems described herein and/or with the individual polishing modules thereof.

FIG. 2 is a side schematic sectional view of the brush box module 200 that may be used with the CMP processing system 100 of FIG. 1. Here, the brush box module 200 is configured to remove polishing byproducts, such as polishing fluid residues, from the surfaces of a substrate by simultaneously urging cylindrically shaped rotating brushes disposed on either side of the substrate against the opposing surfaces. The brush box module 200 comprises one or more walls 216 to form a processing volume 201. The processing volume 201 includes a plurality of brushes 240, disposed on a first side 202 of the processing volume 201 for cleaning a first surface 204 (e.g., frontside) of the substrate 120, and an opposing brush 230, disposed on a second side 203 of the processing volume 201 for cleaning a second surface 205 (e.g., backside) of the substrate 120. Typically, the first surface 204 of the substrate is an active surface, (e.g., a surface used to form electronic devices and/or having at least partially formed electronic devices thereon), and the second surface 205 of the substrate is a non-active surface used for substrate handling. Each of the plurality of brushes 240 and the opposing brush 230 have a surface 241 that contacts the substrate 120 during processing. The surface may comprise nodules, ridges or may be smooth.

As seen in FIG. 2, the brush box module 200 further includes the plurality of brushes 240 each having a brush axis 254 and each selectively positioned around a central support 207 to form a brush carousel assembly 220. The brush carousel assembly 220 shown in FIG. 2 can comprise any number of brushes to form the brush carousel assembly 220. For example, the brush carousel assembly 220 can include 2 brushes, 3 brushes, 4 brushes, 5 brushes, 6 brushes, etc. Although the brush carousel assembly 220 shown in FIG. 2 is disposed on the first side 202 of the processing volume 201 to process the first surface 204 of the substrate 120, the brush carousel assembly 220 can be disposed in an alternative configuration on either or both sides of the processing volume 201 to process either or both surfaces of the substrate. The brush box further includes, the opposing brush 230 disposed on the second side 203 of the processing volume 201 and is positioned adjacent to the brush carousel assembly 220. Although here the opposing brush 230 is disposed on the second side 203 the opposing brush 230 can be disposed on the first side 202 if the brush carousel assembly 220 is disposed on the second side 203. The brush box module 200 may also alternatively include a vacuum chuck in place of the opposing brush 230 to chuck the second surface (e.g., backside) of the substrate 120 to a substrate support. In this configuration, the brush carousel assembly 220 can be disposed on the first side 202 of the processing volume 201, and a vacuum chuck (not shown) can be disposed on the opposite side or vice versa.

Both the brush carousel assembly 220 and the opposing brush 230 are positioned to extend beyond the edge of the substrate 120, to facilitate cleaning of the substrate edges. In one embodiment, brush support arms 245 are disposed in both a horizontal and vertical direction, and include support shafts coupled to the individual brushes 240 of the plurality of brushes 240. For example, a first brush 240, supported by one of the plurality of individual brush support arms 245, may be disposed perpendicular to a second brush 240, supported by one of the plurality of individual brush support arm 245

In the embodiment shown in FIG. 2, each brush 240 is disposed in a parallel manner, such that the brush axis 254 of each brush 240 is parallel to the first surface of the substrate 120 and a central axis 208 of the central support 207. However, in some configurations, it may be beneficial to dispose the brushes 240 in a non-parallel manner to the central axis 208 of the central support 207. For example, the brush axis 254 of each brush 240 may be disposed such that one end of the brush axis 254 is closer to the central axis 208 of the central support 207, so that the processed substrate is urged to travel in a direction along the length of the brush 240 away from a starting point. In this configuration, the brush axis 254 of each brush 240 may be disposed at an angle (e.g., so that the brush is "toe-in") with respect to the central axis 208 of the central support 207. The brush axis 254 may be disposed at any angle less than 30 degrees with respect to the central axis 208 of the central support 207 of the brush carousel assembly 220. For example, the angle can be less than 30 degrees, such as less than 25 degrees, such as less than 20 degrees, such as less than 15 degrees, such as less than 10 degrees, such as less than 5 degrees.

The brush carousel assembly 220 further includes a carriage 209, which includes a carriage support structure 206 configured to rotate about the central axis 208 of the central support 207. The carriage support structure 206 comprises a plurality of individual brush support arms 245 coupled to the central support 207 of the brush carousel assembly 220. Each brush support arm 245 is configured to receive and allow rotation of one of the plurality of brushes 240 via a brush mounting assembly 252, and is configured to urge the respective brush 240 against the first surface of the substrate 120 during a cleaning sequence described in the methods below. The brush carousel assembly 220 is configured such that when the central support 207 rotates about its central axis 208, each of the brush support arms 245 may be individually indexed to a desired position in any direction (i.e., clockwise or counterclockwise), by swinging the plurality of individual brush support arms about a central axis. The rotation of the central support 207 is not limited to a spinning motion of 360 degrees about a central point. Rotation can include pivoting, and/or oscillating. The carriage 209 is rotated by a carousel actuator 250. The carousel actuator 250 may include a stepper motor, or a servo motor that is coupled to the central support via a drive shaft that is coincident with the central axis 208 of the central support 207 so that each of the brushes 240 can revolve along a circular path centered around the central axis 208 of the central support 207.

Each brush mounting assembly 252 is coupled to a brush support arm 245 that can be swung about the central axis 208 of the central support 207. Accordingly, each brush mounting assembly 252 is configured such that when the central support 207 rotates, in either direction (i.e., clockwise or counterclockwise), about its central axis 208, each of the brush mounting assemblies 252 may be individually indexed to a desired position in either direction by swinging each brush mounting assembly 252 about the central axis 208. The travel of each brush mounting assembly 252 is coincident with any neighboring brush mounting assembly 252, such that each brush mounting assembly 252 moves in unison along a travel path about the central axis 208 of the central support 207. However, other configurations where the brush mounting assemblies 252 are moveable about the central axis of the central support 207 can be used. For example, each brush mounting assembly 252 can alternatively be coupled to a circular mounting structure (not shown) coupled to the central support 207 via spindles (not shown) extending from the central support 207 and coupled to the circular mounting structure. As previously mentioned, any number of brushes 240 may be used in the brush carousel assembly 220. Accordingly, any number of brush mounting assemblies 252 may be used to form the brush carousel assembly 220. For example, the brush carousel assembly 220, can include 2 brushes, 3 brushes, 4 brushes, 4 brushes, 6 brushes, etc. As seen in FIG. 3, the brush carousel assembly includes 4 brush mounting assemblies 252 disposed parallel to the central support 207.

The brush carousel assembly 220 also includes a plurality of actuators coupled to the individual brush mounting assemblies 252 to rotate each brush 240 around their respective brush axis 254. Typically, each brush 240 is rotated by an individual actuator coupled to the brush 240. The plurality of individual brush actuators 251 may rotate each brush 240 about each brush axis 254 in either the same or opposite direction as the rotation of the carriage 209 about the central axis 208. For example, each of the plurality of brushes 240 positioned on the plurality of brush mounting assemblies 252 may rotate in a clockwise direction around the brush axis 254 of each central support 253 of each brush mounting assembly 252, and the brush carousel assembly 220 may rotate in a counter-clockwise direction around the central axis 208 of the central support 207. The individual brush actuators 251 may include stepper motors, or servo motors that are coupled to the plurality brush mounting assemblies 252. The individual brush actuators 251 may be coupled to the brush mounting assemblies 252 via a drive shaft that is coincident with the brush axis 254 of each brush mounting assembly 252. In this configuration, each brush 240 can rotate at an independent rate irrespective of the rate of rotation of a proximate brush 240. For example, a first brush 240 may rotate at a first rate, a second brush 240 may rotate at a second rate, and a third brush 240 may rotate at a third rate. The rate of rotation can be determined by the rotational speed of the brush 240 about its brush axis 254.

The brush box module 200 also comprises a platform 212 for supporting the substrate 120. The platform 212 comprises a plurality of rollers 210 (only one shown), which may be configured to support the substrate 120 vertically with minimal contact and which may be adapted to rotate the substrate 120. Although the brush box module 200 is adapted to support the substrate 120 in a vertical orientation for frontside and backside scrubbing, the brush box module 200 may support the substrate 120 in other orientations.

The brush box module 200 further includes a spray system 285. Here, the spray system 285 includes a plurality of liquid supply lines 290, which are coupled to carry a liquid from a liquid source 280 to a plurality of spray nozzles 225 disposed in the brush box module 200. Here, a first spray nozzle 225A is positioned to spray the first surface 204 of the substrate, and a second spray nozzle 225B is positioned to spray the second surface 205. The first spray nozzle 225A is disposed above the brush carousel assembly 220 is a first spray nozzle 225A (i.e., frontside spray nozzle) coupled to the liquid source 280, via a first liquid supply line 290A. Above the opposing brush 230 is a second spray nozzle 225B (i.e., backside spray nozzle) coupled to the liquid source 280, via a second liquid supply line 290B. Although in FIG. 2 only one liquid source 280 is shown, a second liquid source (not shown) can be coupled to either the first or second liquid supply line. In addition, although the first spray nozzle 225A is positioned to spray the first side of the substrate 120, and the second spray nozzle 225B is positioned to spray the second side of the substrate 120, spray from the first nozzle 225A may reach the second side of the substrate 120, and spray from the second nozzle 225B may reach the opposite side of the substrate 120. For example, although a backside spray nozzle may be positioned to only spray the backside of the substrate 120, and a frontside spray nozzle may be positioned to only spray the frontside of the substrate 120, some backside spray may reach the frontside and some frontside spray may reach the backside. In addition, although a plurality of spray nozzles 225 and liquid supply lines 290 are disclosed, the brush box module 200 can comprise a single nozzle 225 coupled to a single supply line 290 positioned to spray both sides of the processing volume 201.

The brush carousel assembly 220 further includes a physical barrier 219. The physical barrier 219 (i.e., splash guard) can comprise any material suitable for fluidly isolating one brush assembly from another proximate brush assembly. Here, the physical barrier 219 is coupled to the central support 207, and is able to be rotated about the central axis 208 along with the support arms 245. The physical barrier 219 can be any shape or size, so long as it does not interfere with the cleaning plates.

The brush carousel assembly 220 further includes a plurality of cleaning plates 211 to clean the plurality of brushes 240. The cleaning plates 211 can comprise any material (e.g., quartz) that may clean the surface of the second brush. In FIG. 2, three cleaning plates 211 are coupled to three cleaning plate supports 260, and are configured to contact the outer surface of a brush 240 disposed on the brush mounting assembly 252. Each cleaning plate is disposed perpendicular to a corresponding brush support arm 245 of the brush carousel assembly 220. Although three cleaning plates 211 are disclosed, any number of cleaning plates 211 can be used. The number of cleaning plates 211 does not have to correspond to the number of brush support arms 245. For example, the brush carousel assembly can comprise four support arms 245 (and corresponding brushes 240) and two cleaning plates 211. Similarly, although three cleaning plate supports 260 are shown, any number of cleaning plate supports 260 may be used.

To allow the cleaning plates 211 to vary their amount of contact with the surface of the brush 240, the three cleaning plate supports 260 are fully adjustable, and can be freely moved in any direction. Although not required, the cleaning plate supports 260 can be coupled to one or more cleaning plate support actuators 261, and to the system controller 160. By varying the amount of contact with the surface of the brush 240, the user can actively adjust the amount of interaction that the surface of the brush 240 engages in with the cleaning plate 211. The ability to adjust the cleaning plates 211 may be particularly useful in applications where the cleaning plates 211 condition the brush 240 in addition to, or in place of, cleaning the brush 240, as the amount effectiveness of either the conditioning or cleaning can be based in part on the amount of contact that the cleaning plate 211 has with the surface of the brush 240 as the brush 240 is urged against a cleaning plate 211.

Figure 3A:
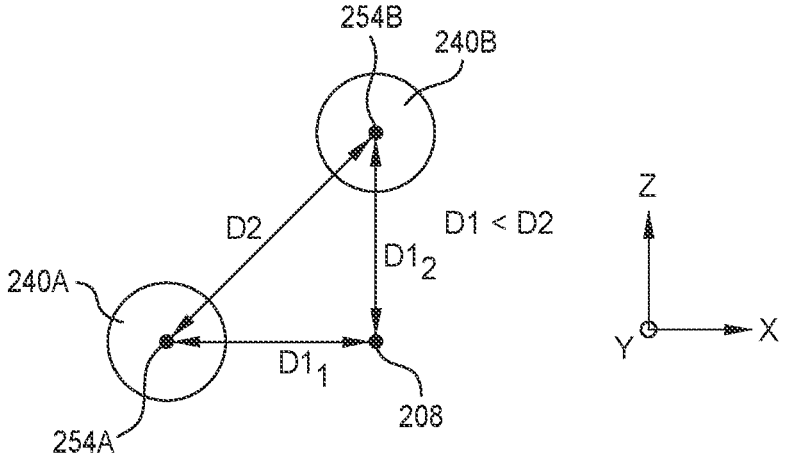
FIG. 3A is a schematic side view of two brushes according to one embodiment of the carousel assembly.

FIG. 3A is a schematic side view of two brushes according to one embodiment of the brush carousel assembly 220. Here, a first brush 240A of the plurality of brushes 240 in the brush carousel assembly 220 is disposed proximate to a second brush 240B of the plurality of brushes 240, such that a first radial distance $D1_1$ from the brush axis 254 of the first brush 240A to the central support axis is less than a brush spacing distance D2 measured from the brush axis 254 of the first brush 240A to the brush axis 254 of the second brush 240B in a direction that is parallel to a plane that includes the first radial distance $D1_1$, i.e., the first radial distance $D1_1$ and the brush spacing D2 being measured in the same plane. In other words, each brush axis is positioned a distance from the carriage axis that is less than a distance measured between each adjacent pair of the brush axes, wherein each of the distances are measured in a plane that is perpendicular to the carriage axis In this configuration, the first radial distance $D1_1$ between the brush axis 254A of the first brush 240A and the central axis 208 and second radial distance $D1_2$ between the brush axis 254B of the second brush 240B and central axis 208 forms a 90 degree angle at the point where the first radial distance $D1_1$ and the second radial distance $D1_2$ intersect. In addition, in at least one embodiment, the first radial distance $D1_1$ and the second radial distance $D1_2$ are equal. Although the distances $D1_1$, $D1_2$, and D2 are shown and described with respect to the adjacent first brush 240A and second brush 240B, it is to be understood that the same relationship applies to all adjacent brushes as shown in FIG. 2.

Figure 3B:
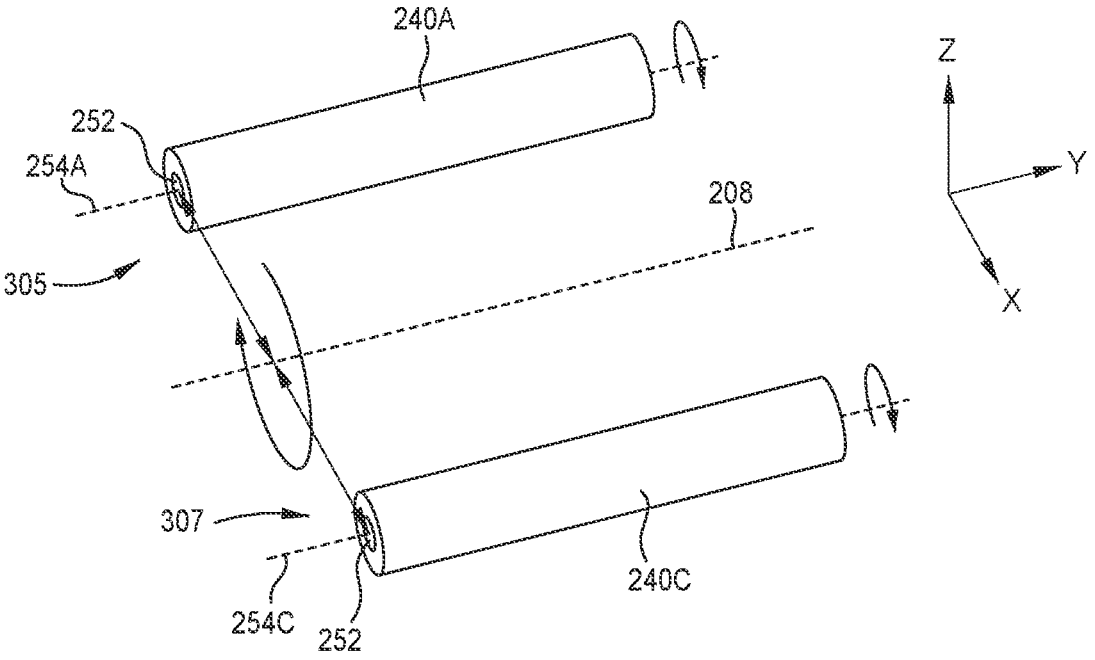
FIG. 3B is a schematic isometric view of two brushes according to one embodiment of the carousel assembly.

FIG. 3B is a schematic isometric view of two brushes according to one embodiment of the brush carousel assembly 220. In this configuration, the first brush 240A, of the plurality of brushes 240 in the brush carousel assembly 220, is positioned at a first position 305, and a third brush 240C, of the plurality of brushes, 240 is positioned at a third position 307. Both the first brush 240A, and the third brush 240C are positioned equidistantly from the central axis 208. Each brush 240 is further positioned parallel to the central axis 208 on a plane that passes through the central axis 208. Although in this configuration, the first brush 240A and the third brush 240C are positioned on plane that passes through the central axis 208, the first brush 240A and third brush 240C can be positioned in a non-planar matter such that the plane on which the first brush 240A and third brush 240C are positioned on does not pass through the central support. As previously mentioned above, each brush 240 can be rotated about its brush axis 254, in a direction of rotation that is different than the direction of rotation of the brush carousel support structure 206 about its central support axis 208.

Figure 4:
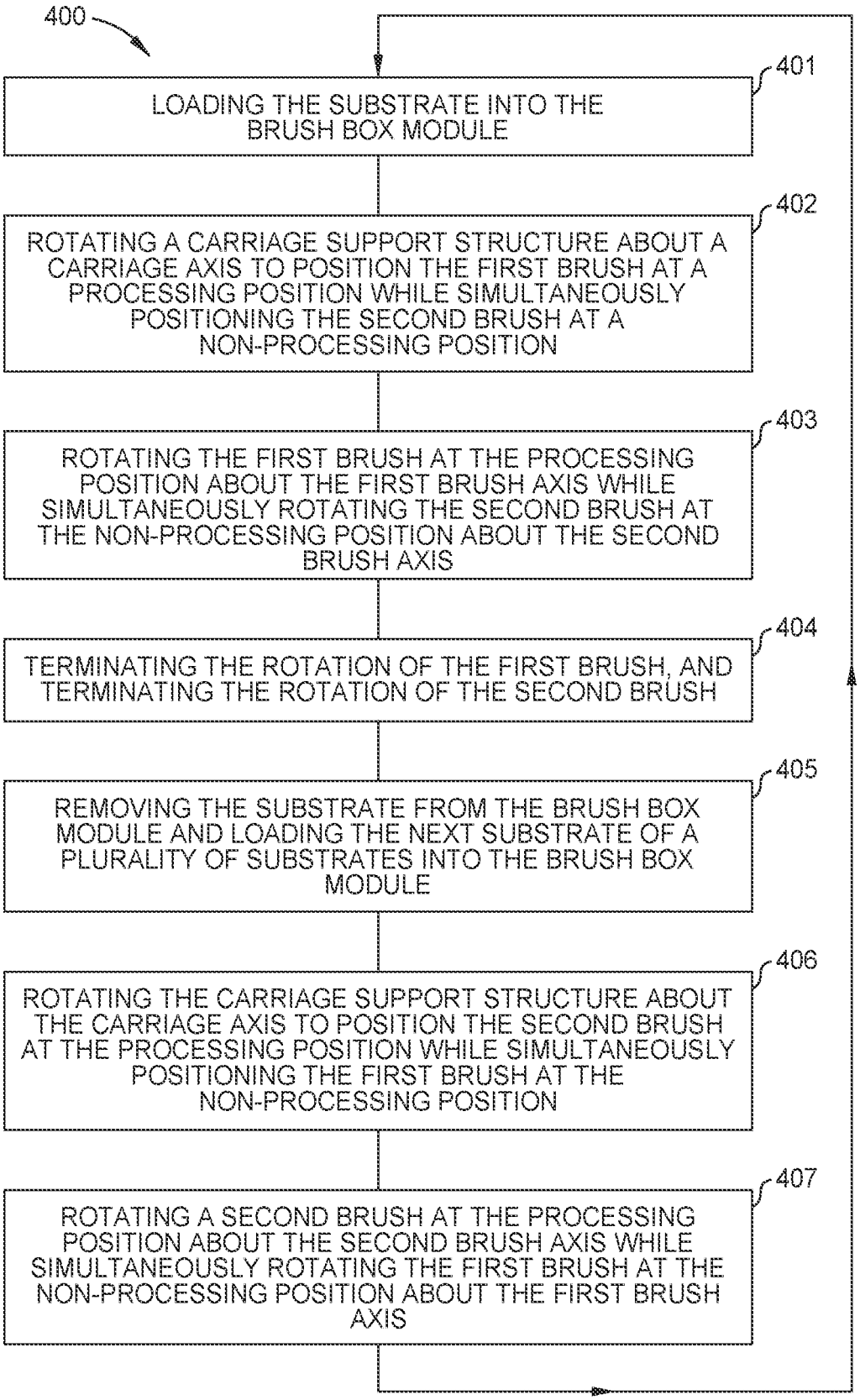
FIG. 4 is a diagram illustrating a method of using the brush box module of FIG. 2 according to one embodiment.

FIG. 4 is a diagram illustrating a method of using the brush box module according to one embodiment. At activity 401, the method 400 includes loading the substrate 120 into the brush box module 200. In operation, the brush carousel assembly 220 and opposing brush 230 are in an initial open position (not shown) a sufficient distance from each other to allow the substrate 120 to be inserted therebetween. Thereafter, the to-be processed substrate 120 is positioned on the platform 212 (i.e., rollers 210) between the brush carousel assembly 220 and the opposing brush 230. Once the substrate 120 is positioned on the rollers, the brush carousel assembly 220 and the opposing brush 230 are moved to a closed position (as seen in FIG. 2), sufficiently close to each other so as to both hold the substrate 120 in place therebetween and to exert a force on the frontside and backside of the substrate 120 sufficient to achieve effective processing.

At activity 402, the method 400 includes rotating the carriage support structure 206 of the brush carousel assembly 220, disposed on the first side 202 of the processing volume 201, about the central axis 208 to position the first brush 240A in a processing position while simultaneously positioning the second brush 240B in a non-processing position. Here, the first brush 240A is positioned to cause the surface of the first brush 240A to be in physical contact with the to-be processed substrate 120 disposed in the brush box module 200. The second brush 240B is also simultaneously positioned in the non-processing position. In this configuration, the non-processing position includes positioning the second brush 240 in a cleaning position such that the surface of the second brush 240B is in physical contact with the cleaning plate 211.

At activity 403, the method 400 includes rotating the first brush 240A at the processing position about the brush axis 254 of the first brush 240A, while simultaneously rotating the second brush 240B at the non-processing position about the brush axis 254 of the second brush 240B. Here, the first brush 240A is rotated about its brush axis 254, at a first rate, and the second brush 240B is rotated about its brush axis 254, at a second rate. Although, the rate of rotation and direction of rotation can be the same, each brush mounting assembly 220 may be independently rotated in either direction at any desired rate. As the first brush 240A is rotated about its brush axis 254, the first brush 240A contacts the surface of the substrate 120 physically removing any unwanted particles. Simultaneously with the first brush 240A rotating about its brush axis 254, the second brush 240B is rotated about its brush axis 254, at the non-processing position. In this configuration, rotating the second brush 240B at the non-processing position includes rotating the second brush 240B at a cleaning position, such that the surface of the second brush 240B, physically contacts the surface of the cleaning plate 211. By contacting the surface of the cleaning plate 211 with the surface of the second brush 240B, the cleaning plate 211 is able to clean the surface of the second brush 240B by removing any particles that have associated themselves with the second brush 240B. By removing any particles associated with the second brush 240B, the cleaning plate 211 is able to reduce the likelihood of subsequent substrate to substrate contamination. In addition, the cleaning plate 211, is not limited to only cleaning the surface of a brush 240. In some configurations, it may be beneficial to condition the brush 240 with a conditioning material in addition to cleaning. For example, a brush conditioning material may be used in place of, or in conjunction with a cleaning material, to condition and/or clean the brush 240. In this configuration, any number of cleaning plates 211 may contain a cleaning and/or conditioning material. For example, in one configuration, a first cleaning plate 211 may contain a material to clean the brush 240, and a second cleaning plate 211 may contain a material to condition the brush 240. The activity 403 further includes rotating the opposing brush 230 about its brush axis 254E, simultaneously with rotating the first brush 240A at the processing position about its brush axis 254A, and rotating the second brush 240B at the non-processing position about its brush axis 254B.

At activity 404, the method 400 includes terminating the rotation of the first brush 240A about its brush axis 254A, terminating the rotation of the second brush 240B about its brush axis 254B, and terminating the rotation of the opposing brush 230 about its brush axis 254E.

At activity 405, the method 400 includes removing the processed substrate 120 from the brush box module 200, and loading the next substrate 120 of a plurality of substrates 120 into the brush box module 200. Typically, after the rotation of the brushes 240 is terminated, the brush carousel assembly 220 and the opposing brush 230 are moved to an open position (not shown) a sufficient distance from each other to allow the substrate 120 to be removed, the substrate is removed from the brush box module 200, and transferred by the transfer robot 124 to the drying unit 170. After the processed substrate 120 is removed, a to-be processed substrate 120 is loaded into the brush box module 200. As previously mentioned at activity 401, the brush carousel assembly 220 and opposing brush 230 are in an initial open position (not shown) a sufficient distance from each other to allow the substrate 120 to be inserted therebetween. The to-be processed substrate 120 is positioned on the platform 212 (i.e., rollers 210) between the brush carousel assembly 220 and the opposing brush 230. Once the substrate is positioned on the platform 212, the brush carousel assembly 220 and the opposing brush 230 are moved to a closed position (as seen in FIG. 2), sufficiently close to each other so as to both hold the substrate 120 in place therebetween and to exert a force on the frontside and backside of the substrate 120 sufficient to achieve effective processing.

At activity 406, the method 400 includes rotating the carriage support structure 206 of the brush carousel assembly 220, about the central axis 208 to position the second brush 240B in the processing position while simultaneously positioning the first brush 240A in the non-processing position. Here, the second brush 240B is positioned in the processing position, such that the surface of the second brush 240B is in physical contact with the to-be processed substrate 120 disposed in the brush box module 200. The first brush 240A is also simultaneously positioned in the non-processing position. In this configuration, the non-processing position includes positioning the first brush 240A in a cleaning position, such that the surface of the first brush 240A is in physical contact with the cleaning plate 211.

At activity 407, the method 400 includes rotating the second brush 240B at the processing position about the second brush axis 254B, while simultaneously rotating the first brush 240A at the non-processing position about the first brush axis 254A. Here, the second brush 240B is rotated about the second brush axis 254B, at a second rate, and the first brush 240A is rotated about the first brush axis 254A at a first rate. As previously mentioned, the rate of rotation and direction of rotation can be the same, but may be different. As the second brush 240B is rotated about the second brush axis 254B, the second brush 240B contacts the surface of the substrate physically removing any unwanted particles. Simultaneously with the second brush 240B rotating about the second brush axis 254B, the first brush 240A is rotated about the first brush axis 254A, at the non-processing position. In this configuration, rotating the first brush 240A at the non-processing position includes rotating the first brush 240A at a cleaning position, such that the surface 241 of the first brush 240A, physically contacts the surface 213 of a cleaning plate 211. By directly contacting the cleaning plate 211 with the surface 241 of the first brush 240A, the cleaning plate 211 is able to clean the surface 241 of the first brush 240A by removing any particles that have associated themselves with the first brush 240A. By removing any particles associated with the first brush 240A, the cleaning plate 211 is able to reduce the likelihood of subsequent substrate to substrate contamination. As previously mentioned, the cleaning plate 211, is not limited to only cleaning the surface 241 of a brush 240, as it may be beneficial to condition the brush 240 with a conditioning material in addition to cleaning. The activity 407 further includes rotating the opposing brush 230 about its brush axis 254E, simultaneously with rotating the second brush 240B at the processing position about its brush axis 254B, and rotating the first brush 240A at the non-processing position about its brush axis 254A.

While the foregoing is directed to embodiments of the present disclosure, other and future embodiments of the disclosure may be devised without departing from the basic scope thereof, and the scope thereof is determined by the claims that follow.

What is claimed is:

1. A brush carousel assembly comprising:

a carriage having a support structure that is configured to rotate about a carriage axis;

a first brush mounting assembly coupled to the support structure of the carriage and comprising one or more rotatable first brush support members coupled to a first brush and rotatable about a first brush axis, wherein the first brush axis is disposed a first radial distance from the carriage axis;

a second brush mounting assembly coupled to the support structure of the carriage and comprising one or more rotatable second brush support members coupled to a second brush and rotatable about a second brush axis, wherein the second brush axis is disposed a second radial distance from the carriage axis; and a plurality of cleaning plates configured to contact an outer surface of the first brush and the second brush, each of the plurality of cleaning plates coupled to one or more cleaning plate actuators configured to move the respective cleaning plate to contact the outer surface of the first brush or the second brush.

2. The brush carousel assembly of claim 1, further comprising a splashguard plate coupled to the carriage and disposed between the first brush mounting assembly and the second brush mounting assembly.

3. The brush carousel assembly of claim 1, further comprising a first brush actuator coupled to the first brush mounting assembly, and a second brush actuator coupled to the second brush mounting assembly.

4. The brush carousel assembly of claim 1, further comprising:

a third brush mounting assembly, wherein the brush carousel assembly is disposed a distance from the third brush mounting assembly such that the first brush mounting assembly and the third brush mounting assembly are configured to be positioned on opposing sides of a substrate when the substrate is positioned for processing within a polishing system.

5. The brush carousel assembly of claim 1, further comprising:

a first brush cleaning plate of the plurality of cleaning plates positioned to contact the second brush mounting assembly when the first brush mounting assembly is in a first position.

6. The brush carousel assembly of claim 5, further comprising a computer readable medium having instructions stored thereon for a method of processing a substrate comprising:

rotating the carriage about the carriage axis to position the first brush in the substrate processing position and the second brush in a brush conditioning position in contact with the first brush cleaning plate;

rotating the first brush about the first brush axis; and concurrently rotating the second brush about the second brush axis.

7. The brush carousel assembly of claim 1, wherein a surface of the first brush has a different pattern than a surface of the second brush, and wherein a first material used to form the first brush has one or more properties that is different from a second material used to form the second brush.

8. The brush carousel assembly claim 1, wherein a radial distance between the first brush axis of the first brush and a central axis is less than a brush spacing distance measured from the first brush axis of the first brush to the second brush axis of the second brush in a plane that includes the radial distance.

9. The brush carousel assembly of claim 1, wherein a first radial distance between the first brush axis of the first brush and a central axis and the second radial distance between the second brush axis of the second brush and a central axis forms a 90 degree angle at a point where the first radial distance and the second radial distance intersect.

10. A polishing system, comprising:

a cleaning chamber comprising:

a brush carousel assembly, comprising:

a carriage configured to rotate or pivot about a carriage axis;

a plurality of first brush mounting assemblies coupled to the carriage, each of the plurality of first brush mounting assemblies comprising one or more rotatable support members configured to support a brush assembly and rotate about a corresponding brush axis, wherein each of the respective brush axes are spaced about the carriage axis; and a second brush mounting assembly disposed a distance from the brush carousel assembly such that one of the plurality of first brush mounting assemblies and the second brush mounting assembly are configured to be positioned on opposing sides of a substrate when the substrate is positioned for processing within the cleaning chamber;

a plurality of polishing stations comprising a polishing pad that is configured to polish the substrate; and a transfer assembly configured to transfer the substrate from one of the plurality of polishing stations to the cleaning chamber.

11. The polishing system of claim 10, wherein the brush carousel assembly further comprises:

a plurality of splashguard plates coupled to the carriage and disposed between each of the first plurality of brush mounting assemblies in a rotational direction of the carriage.

12. The polishing system of claim 10, further comprising a computer readable medium having instructions stored thereon for a method of processing the substrate, comprising:

processing the substrate at one or more of the plurality of polishing stations; and transferring the substrate to the cleaning chamber.

13. The polishing system of claim 10, wherein each brush axis is positioned a distance from the carriage axis that is less than a distance measured between each adjacent pair of the brush axes, wherein each of the distances are measured in a plane that is perpendicular to the carriage axis.

14. The polishing system of claim 11, wherein the brush carousel assembly is disposed on a first side of a platform for supporting a to be processed substrate.

15. The polishing system of claim 11, further comprising:

one or more substrate support rollers for supporting the substrate in a substantially vertical orientation.

* * * * *